US008562202B2

(12) United States Patent
Contamin et al.

(10) Patent No.: US 8,562,202 B2
(45) Date of Patent: Oct. 22, 2013

(54) CONCRETE PRODUCTION PLANT

(75) Inventors: Christian Contamin, Le Plantay (FR); Henri Contamin, Marlieux (FR)

(73) Assignee: Christian Contamin (FR)

( * ) Notice: Subject to any disclaimer, the term of this patent is extended or adjusted under 35 U.S.C. 154(b) by 1015 days.

(21) Appl. No.: 11/915,605

(22) PCT Filed: May 24, 2006

(86) PCT No.: PCT/FR2006/001193

§ 371 (c)(1),
(2), (4) Date: Sep. 2, 2008

(87) PCT Pub. No.: WO2006/125920

PCT Pub. Date: Nov. 30, 2006

(65) Prior Publication Data

US 2009/0135665 A1 May 28, 2009

(30) Foreign Application Priority Data

May 27, 2005 (FR) ..... 05 05390

(51) Int. Cl.
*B28C 5/12* (2006.01)

(52) U.S. Cl.
USPC ..... 366/27; 366/30

(58) Field of Classification Search
USPC ..... 366/27, 30, 33, 37, 50
See application file for complete search history.

(56) References Cited

U.S. PATENT DOCUMENTS

| | | | | |
|---|---|---|---|---|
| 2,003,417 | A * | 6/1935 | Andreas | 414/21 |
| 3,305,222 | A * | 2/1967 | Foster | 366/35 |
| 7,351,025 | B2 * | 4/2008 | Galijan | 414/21 |
| 2005/0219942 | A1 * | 10/2005 | Wallgren | 366/30 |

FOREIGN PATENT DOCUMENTS

| | | |
|---|---|---|
| DE | 19 82 969 | 4/1968 |
| DE | 39 33 314 | 4/1991 |
| EP | 0 587 155 | 3/1994 |
| GB | 1 364 570 | 8/1974 |

OTHER PUBLICATIONS

International Search Report; PCT/FR2006/001193; Nov. 29, 2006.

* cited by examiner

*Primary Examiner* — David Sorkin
(74) *Attorney, Agent, or Firm* — Cantor Colburn LLP

(57) ABSTRACT

The present disclosure allows concrete to be produced on the work site, as and when required, and to limit the space occupied by the production plant.

4 Claims, 2 Drawing Sheets

CONCRETE PRODUCTION PLANT

FIELD OF THE INVENTION

The present disclosure relates to a concrete production device and process.

BACKGROUND

Concrete is generally produced from the following components:

aggregates, comprising sand and gravel, the particle sizes of which can vary according to the desired grade of the concrete;

cement;

one or more optional admixtures; and water.

To produce the concrete, it is known to use a production plant installed on the work site where the concrete is intended to be used.

This plant comprises:

sand and gravel storage containers associated with a shelf for withdrawing the aggregates from each storage container;

at least one silo for storing the cement;

optionally, another silo intended to receive fly ash or filler to be added to the mixture; and optionally, another storage container for a liquid admixture.

At the moment of use, the concrete is produced by mixing the components with water.

It is imperative to measure and set, each day, the degree of moisture of the sand so as to deduce the amount of water incorporated into the concrete in order to keep the water/cement ratio below a specified value, for example 0.60 in the case of a C25/30 cement type.

This limit is imposed by regulations, in order to allow the plasticity of the concrete to be controlled.

Since the mixture is produced by the plant on site, it is necessary to control and set many parameters relating to this mixture, and also the amount of water and the power absorbed by the mixer by means of a controller, which also delivers time data relating to the mixing time.

Such a plant must be checked by a qualified person, as dictated by the regulations.

This type of plant also takes up a very large amount of space owing to the presence of the storage tanks. Moreover, the storage tanks must be protected from moisture, thereby complicating their maintenance.

According to another known method, the concrete is prepared in a plant at some distance from the work site and brought to the work site by trucks called "truck mixers".

This second solution imposes considerable logistic constraints since the delay before using the concrete contained in the truck mixer is limited and the organization of the work on the work site is determined by the arrival of the trucks.

SUMMARY OF THE INVENTION

The present disclosure allows concrete to be produced on the work site, as and when required, and to limit the space occupied by the production plant.

For this purpose, the present disclosure relates to a concrete production plant, characterized in that it comprises:

silo-type storage means comprising at least one compartment intended to receive a mixture of aggregate, cement and one or more optional admixtures;

means for filling the at least one compartment of the silo;

means for receiving the mixture coming from a supply means, especially consisting of a dump truck, and feeding the filling means;

means for withdrawing the mixture contained in the silo; and means for mixing the mixture with water in order to produce the concrete, the means for withdrawing the mixture being placed so as to be distributed over the cross section of the at least one compartment.

These arrangements make it possible to limit the space requirement by having a single silo, with no piles of aggregate. This device does not require the intervention of a qualified operator on the site, since the mixing has already been carried out.

Furthermore, an exemplary embodiment of the present disclosure limits the phenomenon of aggregate segregation.

The segregation phenomenon arises from the migration, within an aggregate mixture, of the larger aggregates to the periphery of the silo. This migration is due to the formation of a cone during top filling, and of an inverted cone during downward withdrawal of the mixture.

The large aggregates are thus driven to the periphery of the silo and will therefore be withdrawn last. Toward the end of withdrawal from the silo, the percentage of large aggregates, that is to say the percentage of gravel, considerably increases and thus creates what is called segregation, and therefore inhomogeneous mixing compared with the start of withdrawal from the silo.

The arrangements of the present disclosure obviate this phenomenon, inherent in the use of a mixture, by adapted withdrawal over the entire cross section of the silo.

Advantageously, the filling means carry out the filling in a manner distributed over the cross section of the silo.

These arrangements also enable the segregation phenomenon to be limited.

According to one embodiment, the filling means comprise a chain elevator and a rotating element provided at its end with a swirler.

Advantageously, the silo comprises at least two compartments intended to receive a mixture of a first type and a mixture of a second type, respectively.

According to one possibility, the means for withdrawing the mixture contained in the silo comprise a set of openings distributed in the lower wall of at least one compartment over the cross section of the latter, especially at the bottom of conical cells.

According to another possibility, the withdrawal means comprise a set of openings placed on the sides of a compartment at several different heights on one or more faces, with closure means controlled by level according to the height of the mixture inside the compartment.

According to yet another possibility, the withdrawal means comprise an endless screw.

Advantageously, the endless screw is protected on its upper part by an apertured closure plate.

The present disclosure also relates to a method of producing concrete, characterized in that it comprises the steps consisting in:

drying aggregates of the sand and gravel type;

mixing the dried aggregates with cement and at least one optional admixture;

filling at least one compartment of a silo with the mixture, said mixture being distributed over the cross section of the silo;

withdrawing the mixture from the silo, the withdrawal of the mixture being distributed over the cross section of the compartment of the silo; and mixing the mixture with water in order to produce the concrete.

According to one possibility, the drying of the aggregates is carried out by trickling, in order to obtain a first type of mixture, the water content of which is between 0.5 and 2%.

According to another possibility, the drying of the aggregates is carried out by heating, in order to obtain a second type of mixture, the water content of which is less than 0.5%.

Advantageously, two compartments of the silo are filled with mixtures of the first and second types, the mixing of the mixture of the first type and the second type with water being carried out alternately.

In any case, the disclosure will be clearly understood with the aid of the following description, with reference to the appended schematic drawing showing, by way of nonlimiting examples, several embodiments of a device according to the disclosure.

DETAILED DESCRIPTION

Figure 1:
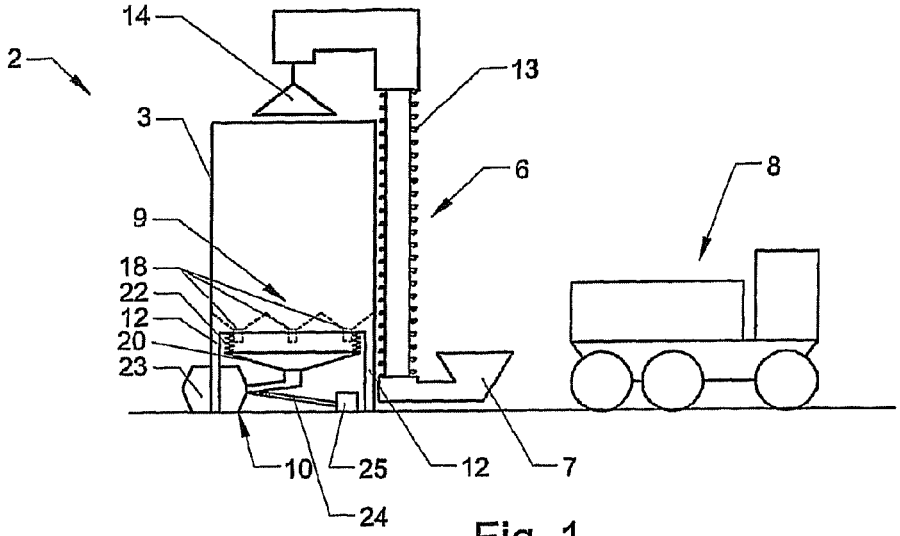
FIG. 1 is a schematic side view of a work site plant according to a first embodiment.
Figure 2:
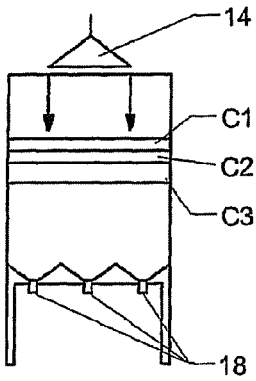
FIG. 2 is a schematic sectional view of one compartment of a silo of the plant shown in FIG. 1, illustrating the way in which it is filled.

The mixture used in the device according to the invention comprises:

aggregates, comprising sand and gravel, the particle sizes of which can vary according to the desired grade of the concrete;

cement; and one or more optional admixtures.

To carry out this mixing of the concrete components, it is necessary, depending on the weather conditions and on the type of gravel used, to dry the aggregates, which may be wet and cause the mixture to set, on a mixture production site.

For this purpose, the aggregates may be dried simply by gravity, or else by heating them in a drum dryer, for example with a feed screw for conveying the gravel.

In the case of drying the aggregates by gravity, it is firstly necessary to store the aggregates so as to eliminate the maximum amount of moisture contained in the sand and the gravel. By keeping moisture away from a pile of aggregate, its moisture trickles down, and the pile dries.

It is also conceivable, in order to obtain the same result, to use centrifugal force instead of gravity.

In the case of drying the aggregates by heating in a drum dryer, for example of the type used for bituminous road mixes, moisture-free aggregates are obtained. This method of drying increases the cost and raises the temperature of the aggregates, which may impair the setting of the concrete in hot weather, when the outdoor temperature is above 15° C.

Consequently, an additional step may be provided, during which the aggregates are stored on the ground while being ventilated, so as to lower their temperature.

The two types of drying operation presented above therefore provide two types of aggregate:

aggregates of the first type, dried by gravity or centrifugal force, with no heating, the water content of which is between 1 and 1.5%; and aggregates of the second type, which are heated, enabling a substantially dry mixture to be formed.

The aggregates of the first type form, with cement and optional admixtures, a mixture that has to be used within a deadline of around one day in order to avoid setting.

The aggregates of the second type make it possible to form a mixture that can be preserved for several days in the silos on the work site.

The mixture of the first type, produced from aggregate of the first type, may represent up to 90% of the amounts used per day on a work site, the mixture of the second type, produced from aggregate of the second type, constituting the remainder.

It is thus possible to envision a daily delivery of mixture of the first type, intended to be entirely consumed within the day, and an occasional delivery of mixture of the second type, making it possible to supply the complement and to adapt the concrete production.

For example, if a work site consumes 55 $m^3$ of concrete on a given day, 50 $m^3$ of this concrete are produced with a mixture of the first type and the complementary 5 $m^3$ will be produced at the end with a mixture of the second type.

The proportions of the mixtures of the first and second types may also vary according to the temperature. This is because, for an outdoor temperature of below 5° C., the rise in temperature of a mixture of the second type during drying is favorable to more rapid setting and an increase in the early strength, making deshuttering at 12 h easier.

he proportions of the mixtures of the first and second types may also vary according to the economic conditions. This is because, for a temperature above 15° C., it may be necessary to add a set retarder, due to the presence of residual water in the mixture of the first type.

When the production cost of this operation is greater than the drying cost, the percentage of mixture of the first type is reduced, or even eliminated, only the mixture of the second type being used.

The two types of mixture described above may be produced in a plant for manufacturing the dry mixture.

The method used allows material to be transported by dump trucks, and truck mixers are not required.

Of course, these dump trucks must be covered with a tarpaulin so as to protect their charge from rain. To remove any residual moisture in the truck, it may be envisioned to blow hot air into it before loading.

Figure 3:
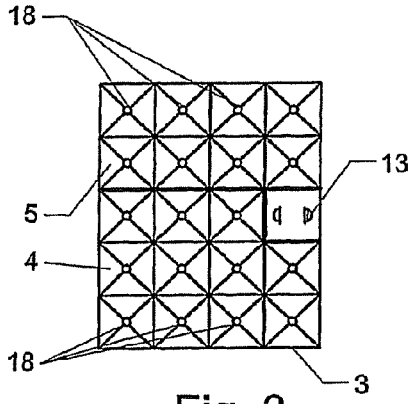
FIG. 3 is a horizontal sectional view of the silo of the plant shown in FIG. 1, according to a variant.

On the work site, a production plant 2 according to the invention is provided that comprises:

a silo 3 for receiving the mixture, this silo comprising two compartments 4, 5, shown separated by a bold line in FIG. 3, which are intended to receive a mixture of the first type or of the second type, respectively;

means 6 for filling the compartments 4, 5 of the silo;

a hopper 7 for receiving the mixture dumped from a dump truck 8 and feeding the filling means 6;

means 9 for withdrawing the mixture contained in the silo; and means 10 for mixing the dry mixture with water.

To give an example:

the dimensions of the horizontal section of the silo 3 may measure 3.5 m by 2.5 m or 3 m, i.e. an area of around 8 to 10 $m^2$ on the ground. A width of 2.5 m or 3 m determines whether the silo is transported by road as a load complying with width regulations or whether it is transported, as an exceptionally wide load, in convoy of the first category; and the total height of the silo may be from 12 to 15 m, the same as the height of work-site plants of the prior art, including feet 12 with a size of 3 m, the compartments 4, 5 being located above the feet 12.

The stock of concrete thus contained is therefore around 60 to 80 $m^3$.

The filling means 6 comprise a bucket chain elevator 13 placed along the silo 3, extending approximately from the ground up to above the compartments 4, 5, and a rotating element provided at its end with a swirler 14, at the upper end of the chain, constituting a means of homogenizing the mixture, for the purpose of preventing the phenomenon of segregation.

Each compartment 4, 5 is thus loaded via the top, homogeneously, as substantially plane successive layers C1, C2, C3, without a pronounced cone being formed.

In the top part of the silo 3, it is possible to add a dedusting filter (not shown), activated during filling.

To reduce the space required on the work site, the noise and the emission of dust, it is possible, according to an alternative embodiment shown in FIG. 3, to fit the chain elevator 13 within the shroud of the silo 3.

According to another embodiment, to make transport easier, the feet 12 can be removed and the bucket chain 13 can be entirely folded down within the shroud of the silo 3.

The hopper 7 for receiving the mixture dumped by a dump truck 8 and feeding the filling means 6 advantageously has a height of less than 1 m in order to make discharge from the trucks easier.

Figure 4:
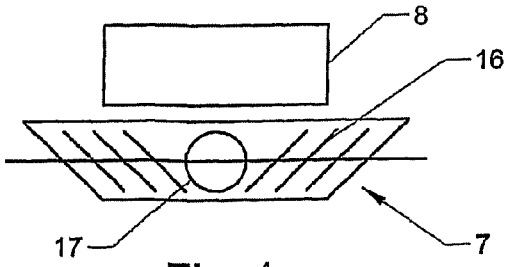
FIG. 4 is a cross-sectional view of the receiving hopper of the plant of FIG. 1.

Since the width of the trucks is generally 2.5 m, the receiving hopper may for example have a width of 3.5 m and may include means 16 for recentering the mixture toward an orifice 17 for loading the chain elevator. The means 16 for recentering the mixture may for example consist of an endless screw of reverse pitch, as shown in FIG. 4.

To make transfer from the truck 8 to the receiving hopper 7 easier, the height of the hopper may be increased, raising the truck by an access ramp.

During the discharge, when the mixture is transferred from the truck to the hopper 7, a system (not shown) for covering the receiving hopper 7 will ensure that it is kept away from water.

According to a first embodiment, the means 9 for withdrawing the mixture contained in the silo 3 include a number of openings 18 distributed on the lower wall 19 of a compartment 4, 5 over the cross section of the latter, at the bottom of conical cells.

This arrangement makes it possible to withdraw, in the lower part of the compartment 4, 5, small doses at points distributed over the cross section of the compartment 4, 5 consecutively and repetitively, in succession on each of the withdrawal openings 18 so as to lower the level of the mixture in a regular fashion.

Thus, no mixture cone forms as in the hoppers of the prior art, thereby preventing the segregation phenomenon.

The means 10 for mixing the dry mixture with water comprise a metering hopper 20 for collecting the dry mixture extracted from a compartment 4, 5 of the silo 3 via the withdrawal means 9, the hopper being located beneath the openings 18.

The weighing means 22 associated with the hopper 20 may be of limited precision, since the indication of the weight serves merely to determine the amount of water to be added to the mixture in order to obtain concrete according to the desired plasticity.

This amount of water will depend on the residual moisture in the mixture, which is:

substantially zero in the case of a mixture of the second type; and around 1 to 1.5% in the case of a mixture of the first type.

The mixing means 10 also comprise a mixer 23 connected to the output of the metering hopper 20, into which the mixture, in a weighed amount, is introduced with water coming from a water inlet 24 associated with control means 25, taking into account the data from the weighing means 22.

The mixer 23 may, according to variants, be a concrete mixing machine, a mixer with a horizontal shaft, a mixer with a vertical shaft, with planetary rotating blades or two horizontal shafts.

The suitable amount of water gives the desired plasticity corresponding to the defined formulation.

Figure 5:
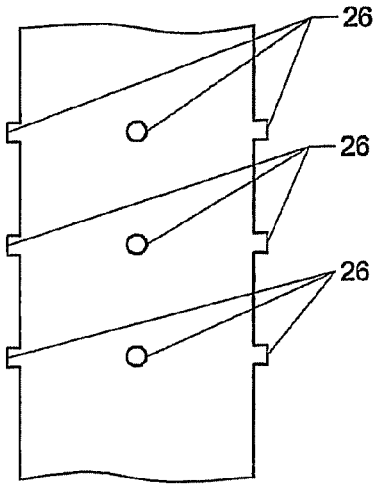
FIG. 5 is a schematic view, in cross section, of one compartment of the silo and of the withdrawal means according to a second embodiment.

According to a second embodiment, shown in FIG. 5, the withdrawal means 26 include a set of openings for taking materials on the sides of the compartment 4, 5 at several different heights on one or more faces, with closure means controlled by level according to the height of the mixture inside the silo 3.

Figure 6:
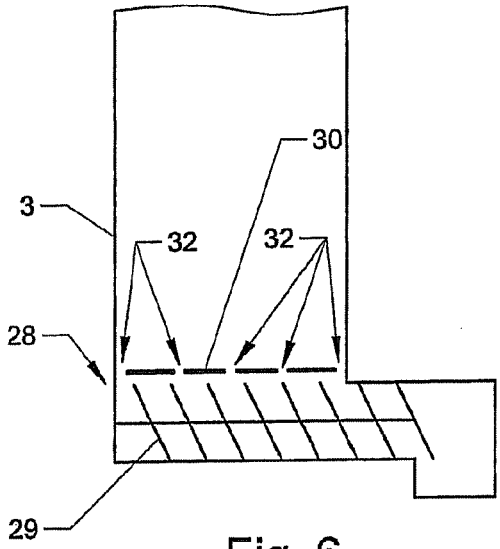
FIG. 6 is a schematic view, in cross section, of one compartment of the silo and of the withdrawal means according to a third embodiment.
Figure 7:
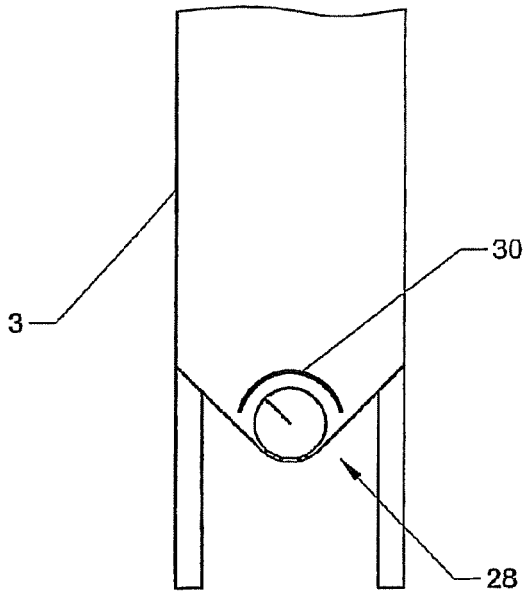
FIG. 7 is a schematic view, in cross section, in a plane perpendicular to the plane of FIG. 6.

According to a third embodiment, shown in FIG. 6, withdrawal means 28 comprise an endless screw 29, advantageously protected over its upper part by an apertured closure plate 30 so as to limit the load on the screw and thus create three or four points at which this screw is fed via the openings 32 in the plate.

As goes without saying, the invention is not limited to the preferred embodiments described above by way of nonlimiting examples; on the contrary, it embraces all variants thereof.

The invention claimed is:

1. A concrete production plant, comprising:

a silo comprising at least one compartment intended to receive a mixture of aggregate, cement and one or more optional admixtures;

means for filling the at least one compartment of the silo;

means for receiving the mixture coming from a supply means and feeding the filling means;

means for withdrawing the mixture contained in the silo; and means for mixing the mixture with water in order to produce the concrete, at least a part of the means for withdrawing the mixture extending across the cross section of the at least one compartment, the means for withdrawing the mixture including a set of openings distributed in a lower wall of at least one compartment over the cross section of the at least one compartment, at the bottom of conical cells, the means for mixing the mixture with water including a metering hopper for collecting the mixture extracted from a compartment of the silo via the withdrawal means, the hopper being located beneath the set of openings.

2. The plant as claimed in claim 1, wherein the filling means carry out the filling in a manner distributed over the cross section of the silo.

3. The plant as claimed in claim 2, wherein the filling means comprise a chain elevator and a rotating element provided at its end with a swirler.

4. The plant as claimed in claim 1, wherein the silo comprises at least two compartments intended to receive a mixture of a first type and a mixture of a second type, respectively.

* * * * *